United States Patent [19]

Lessard

[11] Patent Number: 4,850,414

[45] Date of Patent: Jul. 25, 1989

[54] MOTORIZED BLIND ASSEMBLY

[75] Inventor: Jean Lessard, St. Laurent, Canada

[73] Assignee: Solarium Zytco Ltd., Canada

[21] Appl. No.: 132,571

[22] Filed: Dec. 14, 1987

[51] Int. Cl.[4] ..... E06B 3/94

[52] U.S. Cl. ..... 160/84.1; 160/279

[58] Field of Search ..... 160/84.1, 279, 167, 160/168.1, 172, 107

[56] References Cited

U.S. PATENT DOCUMENTS

| | | | |
|---|---|---|---|
| 3,253,644 | 5/1966 | Gotoh et al. | 160/107 |
| 3,752,208 | 8/1973 | Roberts | 160/1 |
| 3,866,656 | 2/1975 | McCabe | 160/84 |
| 3,977,456 | 8/1976 | McCabe | 160/1 |
| 4,161,204 | 7/1979 | Kurz | 160/1 |
| 4,202,395 | 5/1980 | Heck et al. | 160/84.1 |
| 4,473,101 | 9/1984 | Langeler | 160/84.1 |
| 4,557,309 | 12/1985 | Judkins | 160/84.1 |
| 4,647,488 | 3/1987 | Schnebly et al. | 160/84.1 X |
| 4,673,018 | 6/1987 | Judkins | 160/84.1 |
| 4,679,610 | 7/1987 | Spraggins | 160/84.1 X |
| 4,687,038 | 8/1987 | Clemente | 160/279 X |
| 4,753,281 | 6/1988 | Wagner | 160/84.1 |

*Primary Examiner*—Ramon S. Britts
*Assistant Examiner*—David M. Purol
*Attorney, Agent, or Firm*—Steele, Gould & Fried

[57] ABSTRACT

A motorized blind assembly has top and bottom horizontal end members and a horizontal intermediate blind base member displaceable between the top and bottom members. The ends of a foldable and extensible accordion-like blind are secured, respectively, to the top end member and to the blind base member. An idle pulley is mounted on the bottom end member while a blind drive mechanism is mounted on the top end member; the latter mechanism including a drive friction pulley and a motor assembly able to drive the drive pulley in either of the two directions of rotation. An operating belt winds around the drive and idle pulleys and a mechanism connects the ends of the belt to the base member, this latter mechanism being conceived so that, when the motor assembly is energized, the blind base member moves between the end members causing the blind to fold and unfold. The ends of the belt may alternatively be secured directly to the blind base member.

6 Claims, 3 Drawing Sheets

MOTORIZED BLIND ASSEMBLY

BACKGROUND OF THE INVENTION

1. Field of the invention

The present invention relates to a motorized blind assembly, particularly one using a blind of the accordion type that folds and unfolds between two horizontal end member, such as a top and a bottom end member secured to a window opening.

2. Description of the prior art

Simple motorized blind assemblies of the above general type exist, wherein the actuating motor is push-button operated for raising or lowering the blind, but they are devoid of limit controls so that, if no proper care is taken during operation, the motor heats up when the blind has reached one of its limit conditions (open or closed) and the motor is not immediately stopped. Frequent inadvertent operations of this type rapidly decrease the life expectancy of the motor. In other more appropriate installations, limit switches are used which automatically cut off the current to the blind drive motor, when the blind reaches closed or open positions, and overheating is thus avoided adequately. However, these more sophisticated installations are appreciably costlier and require more maintenance.

SUMMARY OF THE INVENTION

A main object of the present invention lies in providing a motorized blind assembly which, while remaining simple in construction and low in initial and maintenance costs is quite safe insofar as inadvertent overheating of the motor is concerned. Its broad principle lies in the use of an operating belt, which may be a thread or a cord, moving the blind and winding freely around pulleys, including a friction drive pulley connected to the motor, so that should the motor inadvertently override due to the operator failing to stop it in due time, the drive pulley simply turns freely on the belt and overheating is thus avoided.

Searches have been made prior to the filing of the present specification, which searches have failed to reveal any pertinent references, as will be appreciated from the description that follows as compared to the disclosure of the patents found during the searches which include, apart from Canadian Pat. No. 964,682 of Mar. 18, 1978, the following U.S. Pat. Nos.

3,752,208 of Aug. 14, 1973
3,866,656 of Feb. 18, 1975
3,977,456 of Aug. 31, 1976
4,161,204 of July 17, 1979

Canadian patent No. 964,682 corresponds to U.S. Pat. No. 3,752,208.

More specifically, the blind assembly of the invention comprises:

a first and a second horizontal stationary end member spaced from one another and an intermediate horizontal blind base member displaceable between the end members;

a foldable and extensible accordion-like blind and means securing the ends of the blind respectively to the first end member and to the blind base member;

a first idle pulley mounted for free rotation on the first end member;

drive means mounted on the second end member, the drive means including a drive friction pulley and motor means capable of driving the friction pulley in either of the two directions of rotation;

an operating belt winding around the drive and idle pulleys, and means connecting the ends of the operating belt to the blind base member suitable for causing, when the motor means are energized, the blind base member to move between the frame end members and the blind to fold and unfold.

In a preferred embodiment, the belt connecting means comprise:

a second and a third further idle pulleys mounted for free rotation on the blind base member;

a spring on either side of the further idle pulleys; each spring having one end fixed to the blind base member and cooperatively corresponding to one of the further idle pulley, and wherein each end of the operating belt winds around one of the further idle pulleys and is secured, in taut condition of the belt, to the free end of the corresponding spring thereof.

In another embodiment of the invention, the belt connecting means comprise means securing the ends of the belt directly to the blind base member.

Other features of the invention will appear in the description that follows of a preferred embodiment, having reference to the appended drawings.

DESCRIPTION OF THE PREFERRED EMBODIMENTS

Figure 1:
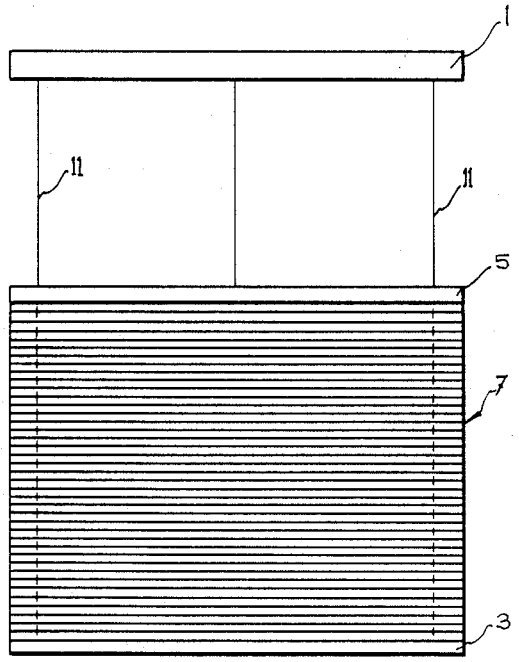
FIG. 1 is a front elevation view.

Referring to FIG. 1, the blind assembly comprises a top and bottom (or first and second) horizontal end members 1, 3, made stationary by fixing them, in any known manner, respectively to the lintel and sill of a window frame (not shown) or to like members of any similar opening which it is intended to close and open. It additionally comprises an intermediate horizontal blind base member 5 displaceable between the end members 1, 3. The foldable and extensible blind 7 proper is of the accordion type, as aforesaid, being formed, when unfolded, of successive V-shaped pleats 9. Its ends are secured, by any convenient means, respectively to the bottom end member 3 and to the intermediate blind base member 5. In the more common variant of FIG. 3, the ends of the blind 7 are connected to the members 1 and 5 but otherwise the two blind assemblies are identical so that the description is restricted to the one shown in FIGS. 1 and 2.

Figure 2:
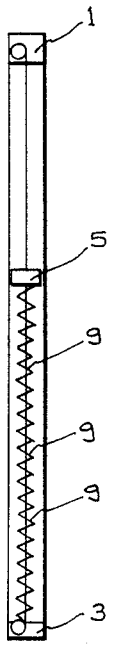
FIG. 2 is a side elevation view, of a motorized blind assembly made according to the invention and wherein the blind moves up from bottom end member.
Figure 3:
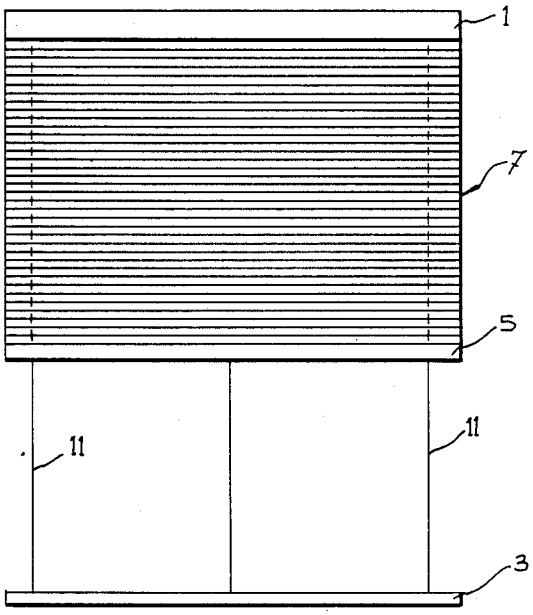
FIG. 3 is a view similar to FIG. 1 but where the blind moves down from a top end member.

As perhaps best seen in FIG. 2, the pleats 9 as well as the blind base member 5 have, at their ends, a series of coaxial holes through each one of which series extends a cord 11 of which the ends are secured to the top and bottom members 1, 3, respectively. These cords 11 serve to guide and hold the pleats properly in alignment when the blind 7 is folded and unfolded.

Figure 4:
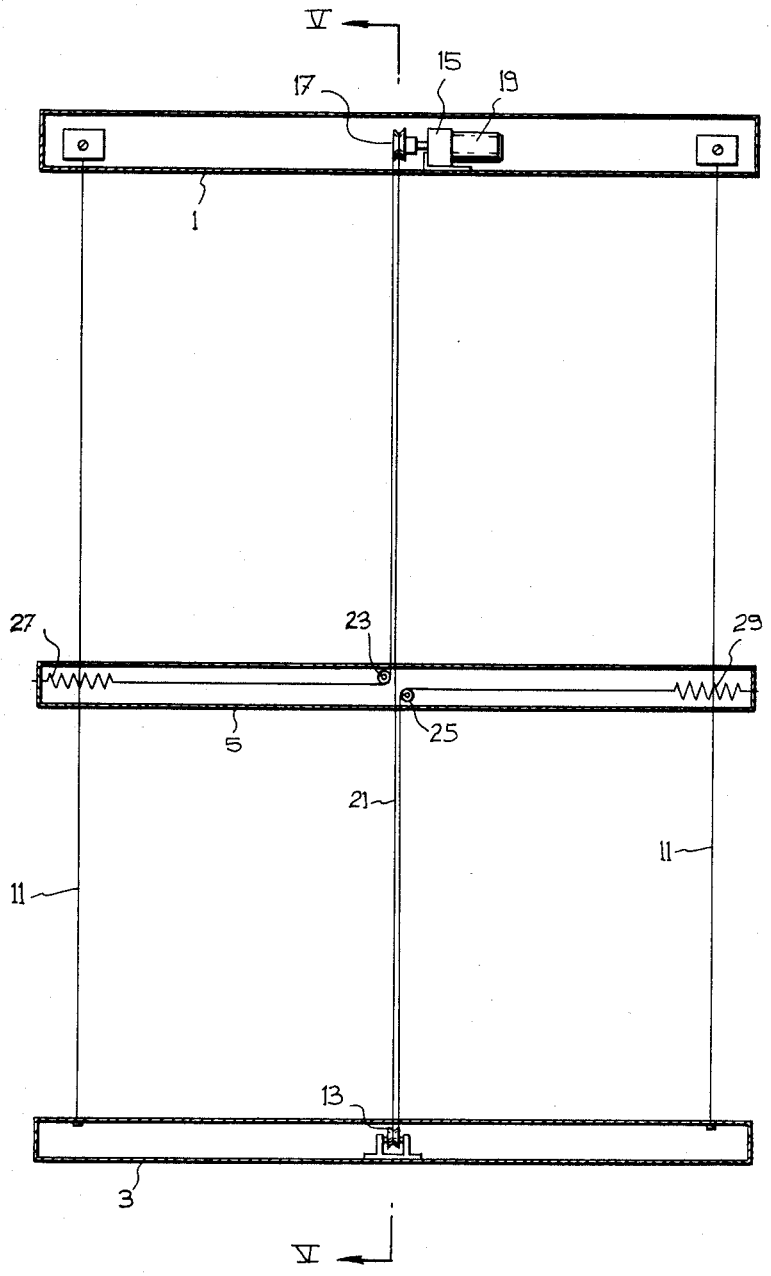
FIG. 4 is a diagrammatic elevation view illustrating the mechanism driving the blind.
Figure 5:
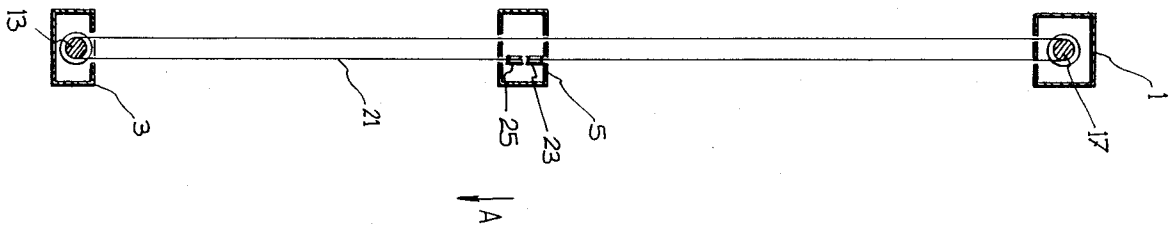
FIG. 5 being a cross-sectional view taken along line V—V of FIG. 4.

The aforementioned mechanism for moving the blind 7 is illustrated in FIGS. 4 and 5 where the blind has been excluded, for clarity. As shown, a first idle pulley 13 is mounted for rotation on the bottom end member 1 while drive means 15 are mounted on the top end member 1. The drive means 15 include a drive friction pulley 17 and a motor 19 capable of driving the pulley 17 into rotation, both being part of an electric circuit (not shown) capable of causing rotation of the motor 19 clockwise or counterclockwise and including a pair of suitable push button switches for causing rotation of the friction pulley 17 in the required direction for raising or lowering the blind 7, as will be explained hereinafter. An operating belt 21 winds around the drive pulley 17 and the first idle pulley 13; means being provided to connect the ends of the operating belt 21 to the blind base member 5 for causing, when the motor 19 is energized, the base member 5 to move vertically between the top and bottom end members 1 and 3 and the blind 7 to fold and unfold, accordingly.

With the above described arrangement wherein the ends of the belt 21 are connected to the blind base member 5, clockwise rotation of the belt by the drive pulley 17 causes the blind base member 5 to fall along arrow A in FIG. 5 thereby folding the blind 7 of FIG. 1. Should the operator then fail to stop the motor 19 when the blind is fully compacted, the pulley 17 will simply turn freely or idle on the belt 21 and the motor 19 will not overheat, which is the main object of the present invention. The same situation will of course exist when the motor is made to run counterclockwise. The blind base member 5 will eventually reach the top member 1 and the blind 7 will be completely unfolded. The drive friction pulley 17 will again turn freely on the belt 21 until the motor 19 is stopped by the operator.

The means that connect the ends of the operating belt 21 to the blind base member 5 preferably comprise a second and a third pulley 23 and 25 mounted for free rotation on the blind base member 5 and springs 27, 29, each on one side of the pulleys 23, 25. As shown, the springs 27, 29, have one end fixed to one end of the base member 5 and the ends of the belt 21 are secured, in taut condition of the belt, to the other ends of the springs after winding partly around the pulleys 23, 25. The springs 27, 29, advantageously serve to avoid building of an undue tension in the belt 21 when the blind base member 5 reaches one of its limit positions and abruptly stops with the motor 19 still running.

On the other hand, the use of the pulleys 23 and 25 as well as of the springs 27 and 29 may be avoided and the ends of the belt 21 be secured directly to the blind base member 5, as will easily be gathered from a modified version of FIG. 5 where the belt 21 makes a simple closed vertical loop with its leftward strand passing freely through the base member 5 and the belt ends secured to the base member. However, in this case, the belt 21 will not have the safeguard against undue belt tension provided by the springs 27, 29.

As shown best in FIG. 5, members 1, 3 and 5 should preferably be hollow rectangular tubes in which the various components above mentioned are hidden from view.

The operating belt 21 may be a simple cord or thread and the pulley 17 may have a V-shaped groove to provide adequate friction therebetween to raise or lower the base member 5 and the blind 7. The grooves of the remaining pulleys may also be V-shaped. As to the pulleys 13, 23, 25 and 17, they may preferably be located centrally of the end members 1, 3, and the blind base member 5, as illustrated in FIG. 4. It will be noted also that the pulleys 13, 17, rotate about axes that extend lengthwise of the top member 1 and bottom member 3, respectively, while the pulleys 23, 25, rotate about axes extending transversely of the blind base member 5.

I claim:

1. A motorized blind assembly, comprising:

first and second horizontal stationary end members, the end members being spaced from one another, and an intermediate horizontal blind base member, displaceable between said first and second end members;

a foldable and extensible accordian-fold blind having two ends, and means securing the ends of said blind respectively to said first end member and to said blind base member;

a first idle pulley mounted for free rotation on said first end member;

drive means mounted on said second end member, said drive means including a drive friction pulley and motor means operable for driving said friction pulley in either of two directions of rotation;

an operating belt winding around said drive and idle pulleys, said belt having ends, and means connecting the ends of said operating belt to said blind base member for causing, when said motor means is energized, said blind base member to move between said stationary end members and said blind to fold and unfold, said connecting means having:

a second idle pulley and a third idle pulley mounted for free rotation on said blind base member;

a spring on either side of said second and third idle pulleys, each spring having one end fixed to said blind base member and another free end facing a closest one of said second and third idle pulleys, and wherein each end of said operating belt winds around one of said second and third idle pulleys and is secured, in taut condition of said belt, to the free end of the closest spring.

2. An assembly as claimed in claim 1, wherein said drive pulley has a V-shaped groove for friction driving engagement therein of said belt.

3. An assembly as claimed in claim 2, wherein said pulleys are located centrally of said end members and of said blind base member, respectively.

4. An assembly as claimed in claim 3, wherein said drive pulley and said first idle pulley are mounted for rotation about axes extending lengthwise of said first and second end members, respectively, and said further pulleys are mounted for rotation about axes extending transverse to said blind base member.

5. An assembly as claimed in claim 4, wherein said blind, in unfolded condition, is formed of successive V-shaped pleats, said pleats and said blind base member having co-axial holes, said blind assembly further comprising a pair of blind guide cords extending through said co-axial holes, said guide cords having ends secured to said end members, respectively.

6. An assembly as claimed in claim 1, wherein said blind, in unfolded condition, if formed of successive V-shaped pleats, said pleats and said blind base member having co-axial holes said blind assembly further comprising a pair of blind guide cords extending through said co-axial holes, said guide cords having ends secured to said end members, respectively.

* * * * *